US005505213A

United States Patent [19]

Webb et al.

[11] Patent Number: 5,505,213

[45] Date of Patent: Apr. 9, 1996

[54] LOAD CONTROL DOFFER

[76] Inventors: Marshall W. Webb, 301 Eason St./P.O. Box 324, MacClesfield, N.C. 27852; Paul S. Rooks, 781 Goldrock Rd., Rocky Mount, N.C. 27804

[21] Appl. No.: 332,874

[22] Filed: Nov. 1, 1994

[51] Int. Cl.[6] ..... A24C 5/39

[52] U.S. Cl. ..... 131/108

[58] Field of Search ..... 131/108; 198/348, 198/601, 371.1, 371.3

[56] References Cited

U.S. PATENT DOCUMENTS

| | | | |
|---|---|---|---|
| 2,785,683 | 3/1957 | Davidson . | |
| 2,826,205 | 3/1958 | Eissmann . | |
| 3,319,772 | 5/1967 | Orlandi . | |
| 3,468,459 | 9/1969 | Bonneric . | |
| 3,557,799 | 1/1971 | Koch et al. . | |
| 3,860,031 | 1/1975 | Grilli . | |
| 3,999,650 | 12/1976 | Gerhardt . | |
| 4,018,674 | 4/1977 | Morris . | |
| 4,135,615 | 1/1979 | Brackman et al. . | |
| 4,220,164 | 9/1980 | Lorenzen . | |
| 4,377,230 | 3/1983 | Bürkner . | |
| 4,390,029 | 6/1983 | Leckband et al. | 131/108 X |
| 4,657,144 | 4/1987 | Martin et al. . | |
| 4,832,058 | 5/1989 | Labbe | 131/108 X |
| 5,322,074 | 6/1994 | Cross | 131/108 X |

*Primary Examiner*—Jennifer Bahr
*Attorney, Agent, or Firm*—Rhodes, Coats & Bennett

[57] ABSTRACT

A tobacco threshing apparatus, and related method, including a plurality of tobacco threshers, each thresher including a housing having an inlet and an outlet, a rotor adapted to be rotated at a constant speed; conveyor for conveying a stream of tobacco leaves; a plurality of doffers positioned to sequentially remove secondary streams from the primary stream, and direct the secondary streams to the threshers; a plurality of measuring devices adapted to measure the ratio of tobacco fed to each thresher; a doffer controller adapted to compare the desired ratio to the actual ratio of tobacco within each secondary stream; and plurality of doffer positioners operable to move the doffers relative to the primary tobacco stream in response to signals from the doffer controller.

23 Claims, 3 Drawing Sheets

LOAD CONTROL DOFFER

BACKGROUND OF THE INVENTION

The present invention relates to a method and apparatus for automatically dividing a primary stream of tobacco leaves into a plurality of secondary streams, each containing a predetermined percentage of the primary stream. As used herein, the term "tobacco leaves" includes leaf pieces as well as whole leaves.

Tobacco leaves are initially received by the tobacco processor from the tobacco auction or an intermediate storage facility in bales or bundles. The processor, after removing the leaves from the bale or bundle, separates the leaves from each other, and cuts or tears the tobacco leaf lamina from the tobacco stem. During this processing, it is frequently necessary to divide an initial stream of tobacco leaves, normally carried from one processing area to another on a conveyor, into two or more streams which are directed to separate processing units. For example, tobacco leaves carried on a conveyor are divided into a plurality of streams that are directed into the inlets of tobacco threshers.

Because of the different sizes of individual tobacco leaves, their physical state, and the fact that leaves overlap and are entangled when initially received, accurate division of a stream of tobacco leaves, or tobacco leaf pieces, into multiple streams containing predetermined percentages of the initial stream is not possible with most devices used to separate streams of other materials.

A method and apparatus which has been found to be reasonably effective for this purpose is described in U.S. Pat. No. 2,785,683 to Davidson. In that apparatus, a spiked roller or doffer is positioned to intersect a stream of falling tobacco leaves discharged from the end of a conveyor belt. The outwardly moving spikes on the roller engage a portion of the tobacco leaves, tearing it away from the main stream, thus dividing the initial stream into two streams of tobacco leaves.

When the doffer is moved further inwardly, a larger percentage of the primary leaf stream is contacted, resulting in a greater percentage of the main stream being diverted. Conversely, movement of the doffer further out of the main stream results in the removal of a smaller percentage of the main stream. Thus, the operator is able to control the relative percentages of tobacco leaves in the two streams by adjusting the position of the doffer within the initial stream.

Heretofore, the operator has effected this adjustment by manually taming a spindle connected to the doffer support with a wrench, with the amount of adjustment being based upon the operator's visual assessment of the percentages or ratio of tobacco within the two streams, or by reading of measurements affected by the varying amount of tobacco, e.g., meters measuring the amperage drawn by thresher motors.

This manual adjustment procedure is often difficult and inconvenient due to location of the doffer. More importantly, the procedure does not result in accurate division of the stream into the desired percentages since the operator's visual assessment is frequently inaccurate, because conditions such as the amount of tobacco in the primary stream fluctuates rapidly, and also because the operator may fail to make changes when indicated. A method and apparatus permitting automatic and accurate control of the doffer position within a falling tobacco stream, and thus the control of the percentages of tobacco within the resultant tobacco streams, would be of great utility.

Accordingly, it is the primary aspect of the present invention to provide a method and apparatus for dividing a primary stream of tobacco leaves into a plurality of secondary streams of tobacco leaves by positioning one or more doffers at least partially within the tobacco stream, and automatically controlling the position of the doffer or doffers in response to the ratio of tobacco in the secondary streams, so that the actual ratio of tobacco in the streams equals a predetermined ratio.

Another aspect of the present invention is to provide a method and apparatus for separating a single stream of tobacco into a plurality of streams of substantially equal volume which are fed to threshing units.

Other aspects of the present invention will be apparent to one skilled in the art upon a reading of the following Summary of The Invention and the Detailed Description of The Preferred Embodiment.

SUMMARY OF THE INVENTION

The present invention provides an apparatus for dividing a primary stream of tobacco leaves into two secondary streams in a predetermined ratio, which in its essential elements comprises a doffer adapted to separate the primary stream into secondary streams; measuring devices adapted to measure a variable indicating the quantities of tobacco within each secondary stream; a doffer controller adapted to receive measurements from the measuring devices, determine therefrom the ratio of tobacco within the secondary streams relative to a predetermined ratio, and transmit a signal when the ratios are different; and a doffer positioner operable to move the doffer relative to the primary tobacco stream in response to a signal from the doffer controller.

A method for dividing a primary stream of tobacco leaves into two secondary streams in a predetermined ratio is also described which comprises inserting a doffer within a primary stream to form secondary streams; measuring a variable indicating the quantities of tobacco within the secondary streams; calculating the ratio of tobacco between the streams from the measurements; comparing the calculated ratio with a desired ratio; and adjusting the position of the doffer within the primary stream when the calculated ratio is different from the desired ratio.

The doffer used in the present invention may be of different configurations, such as in the form of a roller or a conveyor. The doffer surface may include projections, such as paddles or spikes, to engage tobacco leaves coming into contact with the moving surface, or it may have a smooth surface.

The doffer positioner includes a support adapted to support the doffer at any point between an inner position at which substantially all of the upper doffer surface is within the primary tobacco stream, and an outer position at which substantially all of the upper surface of the doffer is away from the primary tobacco stream; and a drive means adapted to change the position of the doffer support to move the doffer to any desired position between the inner and outer positions in response to a signal from the doffer controller. The drive means may be, for example, a servo motor and a connecting linkage between the motor and the doffer support.

Measurement of the variable indicating the amount of tobacco being fed to the threshing receivers or other stream receivers is achieved with a measuring device, which may be of various designs depending on the variable being measured. For example, if the streams are being received on weigh belts, measuring devices may be used to measure the weight of tobacco on the belts. On the other hand, a photocell may be used if the variable being measured is the height of the tobacco stream.

Alteratively, when the secondary streams are fed to similar processing units drawing varying amounts of electrical current depending on the amount of tobacco being received, the amount of current can be measured to indicate the amount of tobacco. For example, in the preferred embodiment described hereinafter, tobacco streams are fed to threshers of similar construction. In each thresher, the tobacco leaves are subjected to the action of a leaf cutting or tearing device rotated at a constant speed by a DC motor. When a small amount of tobacco is being processed, the ripping device rotates at the desired speed with only a small amperage load being required on the drive motor. When relatively larger quantities of tobacco are being threshed, however, a relatively higher amperage load on the motor is required to maintain the desired speed.

Thus, by monitoring the amperage load, or current being drawn, on the thresher motor, it is possible to determine the amount of tobacco being processed by the thresher at a given time. Also, by monitoring the amperage load on the motors in a plurality of threshers, it is possible to determine the quantity of tobacco processed within each thresher relative to the total quantity of tobacco being processed by all threshers, and thus the ratio of tobacco in the secondary streams. For example, when the load on all thresher motors is equal, as indicated by an equal current flow to all motors, the amount of tobacco in all streams will be equal.

Signals, generally electrical, corresponding to measurements made by the measuring devices are transmitted to a microprocessor or doffer controller, which calculates the ratio of tobacco between the streams from the measurements, and compares the calculated ratio with a predetermined ratio. If the actual ratio is different from a desired ratio, then the controller transmits a signal to each actuator or doffer positioner directing the positioner to change the position of the attached doffer, either inwardly or outwardly, thus changing the quantity of tobacco being removed from the primary stream by the doffer. As a result, the ratio of tobacco in the streams will change, changing the measurements transmitted to the controller. When these measurements indicate that the actual ratio corresponds to the desired ratio, the controller will halt further adjustment of the doffer.

In order to make this calculation, the doffer controller determines the sum of the variables measured by the measuring devices, determines the ratio of each variable measured to the sum of the variables, and compares this ratio to a desired ratio. In most instances, it is desirable to have equal amounts of tobacco in each stream. In this case, the sum of the variables is divided by the number of said secondary streams to obtain the desired variable value for each stream. This value is then compared to each measured value.

Thus, if it is desired to produce four streams, three doffers will be used and three variables will be measured, since one of the streams will be formed of the residue of the primary stream. Each of these variable values will be equal to one-third of the sum of all of the variables, i.e., a ratio of 1:3. If a measured variable value is less than this value, the controller will signal the corresponding doffer positioner to move the doffer further into the primary tobacco stream. Conversely, the controller will signal the doffer positioner to move the doffer further out of the stream if the measured value is more than the desired value.

Since there is likely to be some inherent variation in the parameter being measured and in measuring devices due to their construction or positioning, the measuring devices will be adjusted to a base value to eliminate any inherent difference. For example, ammeters used to measure amperage load to motors will be adjusted to zero or another common value when the motors are running without tobacco being present.

In most processing facilities, more than one doffer will be required to separate a primary stream of tobacco leaves into the desired number of secondary streams to be directed to processing units. For example, a primary stream of tobacco leaves may be divided into four secondary streams containing equal amounts of tobacco leaves, with each stream being directed to a thresher that tears tobacco leaves between a rotating toothed cylinder or rotor and stationary teeth adjacent the cylinder. Pieces of the desired size are then discharged from the threshers onto another conveyor for further processing.

As previously noted, three adjustable doffers may be used to divide a primary tobacco leaf stream into four equal secondary streams. The primary stream is first discharged from an initial conveyor onto a fast rotating doffer positioned beneath the discharge end of the conveyor. This doffer, which rotates in a direction opposite that of the conveyor, removes a first segment of the initial stream and directs it to a first thresher. The remainder to the stream falls onto a second conveyor, and is then discharged onto a second doffer which removes a second segment of the stream and directs it to a second thresher. The remaining stream falls onto a third conveyor. The procedure is repeated at the end of the third conveyor, with a third doffer directing a third segment of the stream to a third thresher. The remainder of the tobacco stream, constituting the fourth stream segment, falls onto a fourth conveyor, and is conveyed to a fourth thresher.

Desirably, the amount of tobacco in each stream segment will all be approximately one-fourth of the amount present initially in the primary stream, so that each thresher will operate at the same load level, providing the highest efficiency and best threshing. In practice, however, the amounts fed to the four threshers, even if equal initially, will vary over time due to variations in the volume of tobacco in the initial primary stream, tobacco leaf sizes, moisture content, etc. Therefore, it is necessary to periodically adjust the position of the doffers to compensate for these variations. As noted above, this adjustment has previously been done manually by the operator.

In accordance with the present invention, the positions of the three doffers are changed automatically in response to differences in the volume of tobacco within the stream segments. This adjustment is preferably achieved by measuring the magnitude of an indicator representing the amount of tobacco being fed to each thresher, totaling the measurements made, dividing the calculated total by the number of threshers to determine the desired magnitude of an indicator for a single thresher, comparing the calculated magnitude with the actual magnitude for each thresher, and adjusting the doffer position to adjust for any difference.

This measurement is made for all threshers. Since the position of one doffer will affect the relative quantities being fed to the other threshers, and thus the desired portion of the other doffers, the doffers are preferably adjusted in sequence, beginning with the first doffer contacted by the primary tobacco stream, and continuing downstream until all doffers have been adjusted.

In operation, a portion of a falling, initial primary tobacco leaf stream contacts the surface of a first doffer which removes a segment of the primary stream to form a secondary stream that is directed to a processing unit, such as a thresher. This procedure is repeated until the desired number of secondary streams are generated.

The percentage of tobacco within each secondary stream relative to the initial primary stream, i.e., the total amount of tobacco being processed is determined by measuring the magnitude of an indicator of the amount of each stream, and determining from the measurements made the desired amount of tobacco in each stream. The calculated percentage is then compared with the actual percentage. For example, if it is desired to have the initial primary stream divided into equal amounts within each secondary stream, the measurements for all streams will be added together and divided by the number of streams. The measured amount will then be compared with the actual amount for each stream.

If the calculated amount is different from the measured amount, a signal is sent to the doffer positioner, commanding the positioner to move the doffer so that it contacts more or less of the primary stream, thus increasing or decreasing the amount of tobacco separated.

DETAILED DESCRIPTION OF THE PREFERRED EMBODIMENT

In the preferred embodiment, the initial primary stream in divided into four equal secondary streams which are directed to threshers. It will be apparent to one skilled in the art, however, that the primary stream may be divided into fewer or more secondary streams and/or directed to different types of processing units.

Figure 1:
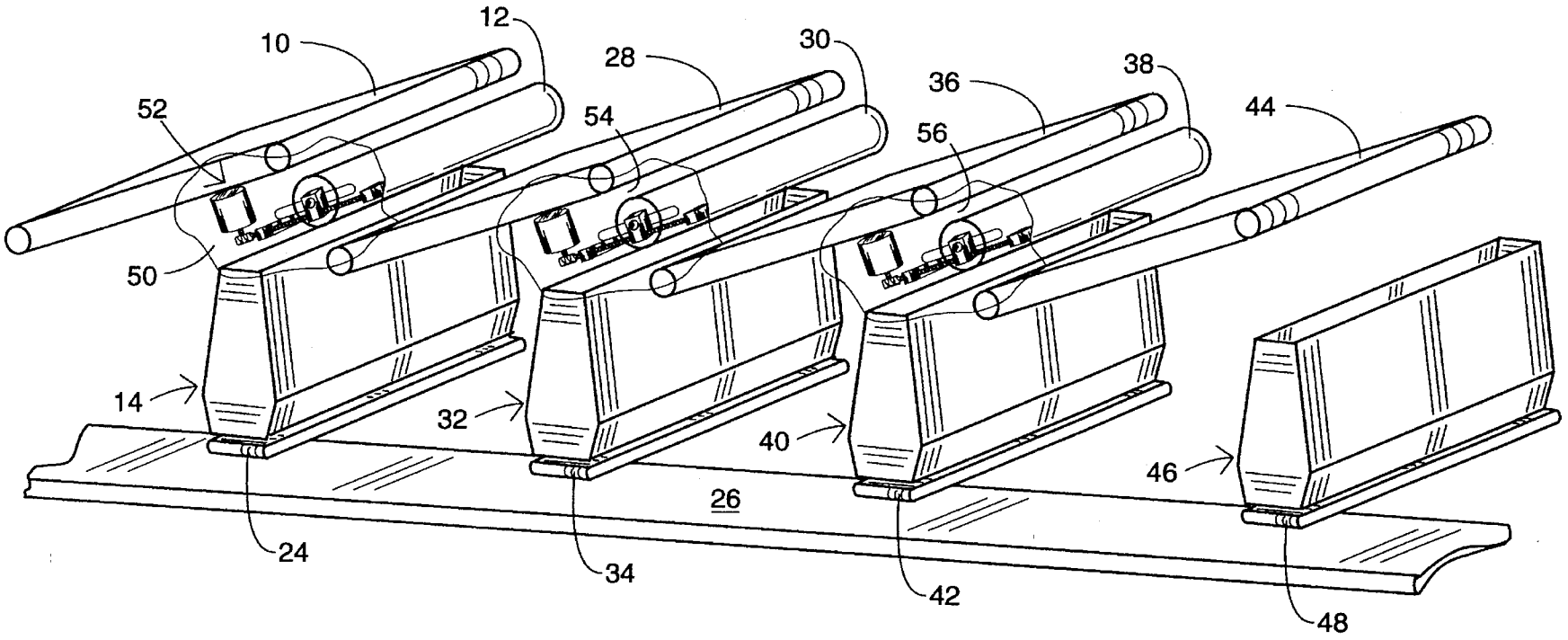
FIG. 1 is a perspective view of the apparatus.
Figure 2:
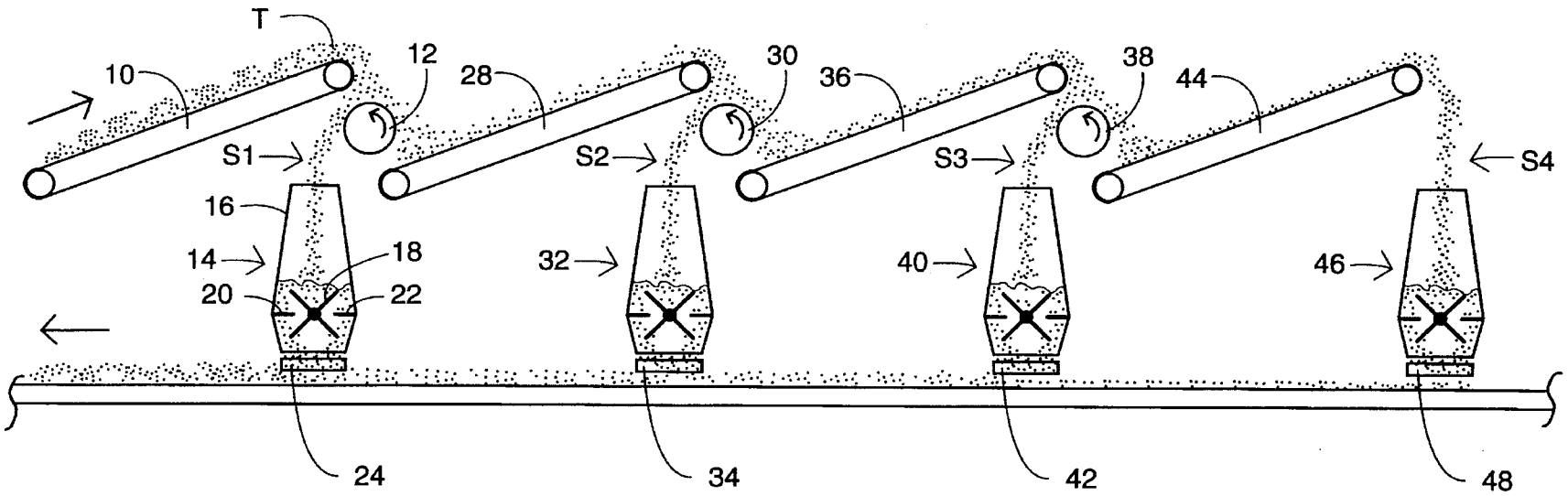
FIG. 2 is a side view of the apparatus of FIG. 1 schematically illustrating the path followed by the tobacco leaves being processed.

As best shown in FIGS. 1 and 2, the apparatus of the preferred embodiment is comprised of a first conveyor 10 to convey the initial primary stream of tobacco T. A first doffer 12 is positioned beneath the discharge end of conveyor 10, so that tobacco falling from the discharge end of conveyor 10 will fall onto the upper surface of doffer 12. Rotation of doffer 12 inwardly, as shown in the drawings, causes a portion of tobacco stream T to be removed as first segment S1 which is discharged into the inlet of a first thresher 14. Thresher 14 is of conventional design and is comprised of a housing 16 having an upper inlet and a lower discharge opening, a toothed rotor 18 with outwardly extending blades, and stationary blades 20 and 22. A conveyor 24 is positioned beneath thresher 14 to received threshed tobacco and convey the tobacco to common conveyor 26.

The portion of tobacco stream T not removed by doffer 12, approximately three-fourths of the initial stream, falls past doffer 12 onto a second conveyor 28. A second doffer 30 is positioned beneath the discharge end of conveyor 28 to engage tobacco falling therefrom. Doffer 30 removes a part of stream T to form a second segment S2, which is directed to a second thresher 32 having a structure like thresher 14. Conveyor 34 beneath thresher 32 transfers tobacco discharged by thresher 32 onto conveyor 26.

The portion of tobacco stream T not removed by doffer 30, approximately one-half of the initial stream, falls past doffer 30 onto a third conveyor 36. A third doffer 38 is positioned beneath the discharge end of conveyor 36 to engage tobacco falling therefrom. Doffer 38 removes a part of stream T to form a third segment S3, which is directed to a third thresher 40 having a structure like thresher 14. Conveyor 42 beneath thresher 40 transfers tobacco discharged by thresher 40 onto conveyor 26.

The remainder of tobacco stream T, approximately one-fourth of the initial stream, falls past doffer 40 onto a fourth conveyor 44, and is deposited into a fourth thresher 46 as segment S4. Thresher 46 is constructed like thresher 14. Conveyor 48 beneath thresher 46 transfers the threshed tobacco to common conveyor 26.

The preceding conveyors 10, 28, 36 and 44, and doffers 12, 30 and 38, are positioned within a housing 50 largely cut-away in the drawings to show the conveyors and doffers. The ends of doffers 12, 30 and 38 are mounted on doffer positioners 52, 54 and 56, respectively, which, in turn, are mounted on the exterior of housing 50.

Figure 3:
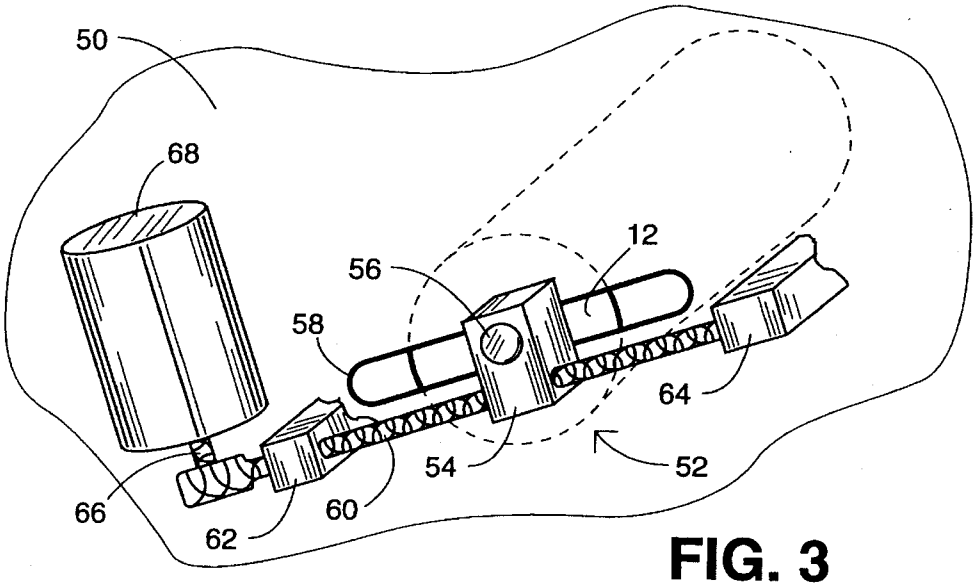
FIG. 3 is a perspective view of the doffer positioner.
Figure 4:
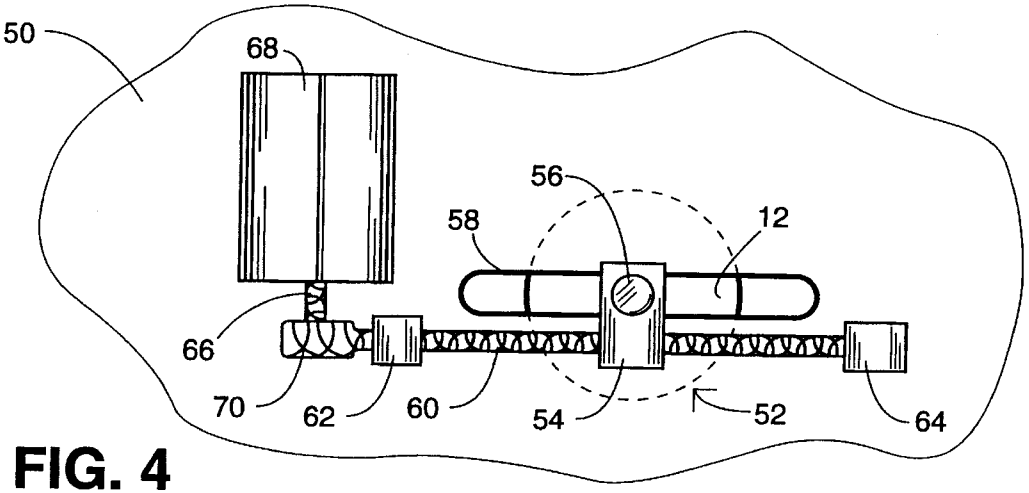
FIG. 4 is a side view of the doffer positioner.

As best shown in FIGS. 3 and 4, doffer positioner 52 is comprised of a doffer mounting block 54 supporting the end of central axle 56 of doffer 12, which extends outwardly through a slot 58 in housing 50. Block 54 rides along an upwardly inclined screw shaft 60, mounted on housing 50 with shaft mounting blocks 62 and 64. Shaft 66 of servo motor 68 engages the end of shaft 60 with worm gear 70. Doffer positioners 54 and 56 are of the same construction.

Figure 5:
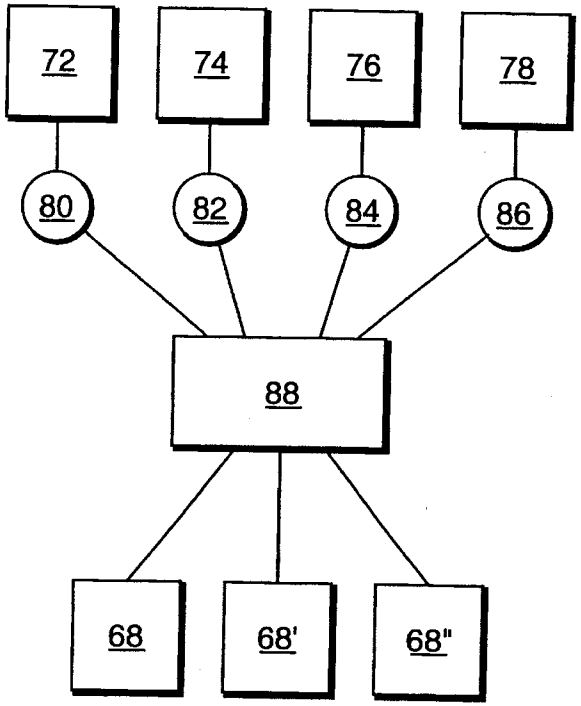
FIG. 5 is a diagram of the interrelationship between the components.

As shown in FIG. 5, current flow to drive motors 72, 74, 76 and 78, which drive threshers 14, 32, 40 and 46, respectively, at constant speeds, are monitored by ammeters 80, 82 84 and 86, respectively, adjusted to a common base value before tobacco processing. The current measurements are transmitted to microprocessor 88, which is also connected to servo motors 68, 68' and 68".

In operation, an initial stream of tobacco leaves T is deposited on conveyor 10 and is discharged by gravity from the forward end of conveyor 10, so that a part of stream T engages the upper surface of doffer 12. The portion of stream T engaging doffer 12 is separated from the main stream as segment S1, which is directed into the inlet of thresher 14. In thresher 14, the leaves are tom as they pass between toothed rotor 18 and stationary teeth 20 and 22.

Rotor 18 is tamed by motor 72 at a constant speed, regardless of the amount of tobacco within thresher 14. Thus, the force required to mm rotor 18 will vary depending on the amount of tobacco present. This variation will be reflected in the amperage load or current flow to motor 72, which will be proportional to the amount of tobacco present. This current flow is measured by ammeter 80 in the circuit connecting motor 72 to an electrical source.

Tobacco not removed from stream T by doffer 12 falls past doffer 12 onto conveyor 28 and is discharged therefrom by gravity toward a second doffer 30 which engages a part of stream T to remove a segment S2, which is directed into the inlet of thresher 32. The current flow to motor 74 driving the rotor of thresher 32 is measured by ammeter 82 connected in-line with motor 74.

Tobacco not removed by doffer 30 falls onto conveyor 36 and is discharged onto doffer 38 which removes a third segment S3, which is directed into a third thresher 40, having a motor 76, and an ammeter 84 measuring the current flow to motor 76. The remaining tobacco falls on conveyor 44, and is discharged into a fourth thresher 46. Ammeter 86 measures the current flow to motor 78 of thresher 86.

Current flows measured by ammeters 80, 82, 84 and 86 are transmitted to microprocessor 88, which adds the amperage values together to obtain a total current flow. The total current flow is then divided by the total number of threshers, i.e., four, to obtain the desired current flow per thresher. Microprocessor 88 then compares this desired flow to the measured actual flow to thresher 14. If the desired and actual flows are different, microprocessor 88 transmits a signal to servo motor 68, which turns shaft 66, moving doffer 12 further into or out of stream T, to increase or reduce the amount of tobacco directed to thresher 14. As a result of the change in tobacco entering thresher 14, the current flow to motor 72 is increased or decreased, as the case may be, to the desired level. This procedure is sequentially repeated to adjust doffers 30 and 38.

Certain modifications and improvements will occur to those skilled in the art upon a reading of the foregoing description. By way of example, other means may be employed to move the doffers to the desired positions. Also, the segments can be directed to other conveyors before entering the processing units. It should be understood that all such modifications and improvements have been deleted herein for the sake of conciseness and readability but are properly within the scope of the following claims.

What is claimed is:

1. An apparatus for dividing a primary stream of tobacco leaves into two secondary streams in a predetermined ratio comprising:

(a) a doffer adapted to separate said primary stream into secondary streams;

(b) measuring devices adapted to measure a variable indicating the quantities of tobacco within each secondary stream;

(c) a doffer controller adapted to receive measurements from said measuring devices, determine the ratio of tobacco within said secondary streams relative to a predetermined ratio, and transmit a signal when the ratios are different; and (d) a doffer positioner operable to move said doffer relative to said primary tobacco stream in response to said signal.

2. The apparatus of claim 1, wherein said doffer includes a rotatable surface movable within said primary tobacco stream.

3. The apparatus of claim 1, wherein said measuring devices are ammeters.

4. The apparatus of claim 1, further including a first stream receiver and a second stream receiver.

5. The apparatus of claim 4, wherein said first and second stream receivers are tobacco leaf threshers including constant speed electric motors.

6. A method of dividing a primary stream of tobacco leaves into two secondary streams in a predetermined ratio comprising:

(a) inserting a doffer within said primary stream to form secondary streams;

(b) measuring a variable indicating the quantities of tobacco within said secondary streams;

(c) calculating the ratio of tobacco between said streams from said measurements;

(d) comparing the calculated ratio with a predetermined ratio; and (e) adjusting the position of the doffer within the primary stream when the calculated ratio is different from the predetermined ratio.

7. The method of claim 6, wherein the variable measured is electrical current.

8. The method of claim 6, wherein the sum of said variables are divided by the number of said secondary streams, and the resulting value is compared to a predetermined value.

9. The method of claim 6, wherein said predetermined ratio is 1:3.

10. An apparatus for dividing a primary source of tobacco leaves into a plurality of streams having substantially equal volumes comprising:

(a) a plurality of doffers positioned to engage a portion of said primary source and remove segments therefrom;

(b) a plurality of measuring devices adapted to measure the quantities of tobacco within said streams;

(c) a doffer controller adapted to receive measurements from said measuring devices, determine the percentages of tobacco within said streams, and transmit a signal when the percentages are unequal; and (d) a plurality of doffer positioners operable to move said doffers relative to said primary tobacco stream in response to signals from said doffer controller.

11. The apparatus of claim 10, wherein said source of tobacco is divided into four secondary streams having substantially equal volumes.

12. The apparatus of claim 11, having first, second and third doffers positioned to sequentially engage said primary source of tobacco leaves.

13. The apparatus of claim 12, including conveyors to convey the primary source of tobacco leaves to said doffers.

14. The apparatus of claim 13, wherein said doffers are adjustably positioned beneath the discharge ends of said conveyors.

15. The apparatus of claim 10, further including tobacco leaf processing units positioned to receive said streams.

16. A tobacco threshing apparatus comprising:

(a) a plurality of tobacco threshers, each thresher including a housing having an inlet and an outlet, a rotor and a motor adapted to rotate said rotor at a constant speed;

(b) conveyor means for conveying a stream of tobacco leaves;

(c) a plurality of doffers positioned to sequentially remove secondary streams from said primary stream, and direct said secondary streams to said threshers;

(d) a plurality of ammeters adapted to measure the current to said thresher motors;

(e) a doffer controller adapted to calculate the desired percentage and actual percentage of tobacco within each secondary stream based on the currents measured, and transmit signals when said percentages are different; and (f) a plurality of doffer positioners operable to move said doffers relative to said primary tobacco stream in response to signals from said doffer controller.

17. The apparatus of claim 16, wherein said doffer controller is adapted to sum the currents measured by said ammeters, determine the percentage of each current measured to the sum of the current, and compare said percentage to a predetermined percentage.

18. The apparatus of claim 17, wherein said percentage in equal to the number of streams divided by 1.

19. The apparatus of claim 16, wherein said conveyor means is comprised of a plurality of upwardly inclined conveyors.

20. The apparatus of claim 16, wherein said doffers are comprised of rotatable rollers adapted to rotate in a direction opposite to the movement of said conveyor means.

21. The apparatus of claim 16, wherein each of said doffer positioners comprises a servo motor, a screw shaft rotatable by said servo motor, and a block carried by said shalt and supporting an end of said doffer.

22. The apparatus of claim 16, including four threshers, and three doffers.

23. A method for dividing a primary stream of tobacco leaves into a plurality of secondary streams having substantially equal volumes comprising:

(a) positioning a plurality of doffers to engage a portion of said primary stream and form a plurality of secondary streams therefrom;

(b) measuring a variable indicating the quantity of tobacco within each stream;

(c) determining the stun of all variables measured;

(d) dividing said sum by the number of streams to determine the desired variable level;

(e) comparing the desired level and actual level of each measured variable; and (f) moving said doffers relative to said primary tobacco stream when said levels are different.

* * * * *